US006238278B1

(12) United States Patent
Haftmann

(10) Patent No.: US 6,238,278 B1
(45) **Date of Patent: *May 29, 2001**

(54) FERRULE HOLDER AND FERRULE GRINDING APPARATUS

(76) Inventor: Johannes Haftmann, Schaftnacherweg 31, Ridnitzhembach (DE), 91126

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,957

(22) Filed: Nov. 4, 1997

(30) Foreign Application Priority Data

Nov. 15, 1996 (EP) ..... 96118370

(51) Int. Cl.[7] ..... B24B 7/22; B24B 41/06

(52) U.S. Cl. ..... 451/279; 451/278; 451/390; 451/41

(58) Field of Search ..... 451/41, 42, 64, 451/67, 231, 232, 278, 279, 384, 386, 387, 389, 390; 385/85

(56) References Cited

U.S. PATENT DOCUMENTS 4,776,136 10/1988 Abendeschein et al. .
5,018,316 * 5/1991 Mulholland et al. ..... 451/364
5,140,779 * 8/1992 Grois ..... 451/386 X
5,201,148 * 4/1993 Rupert et al. ..... 451/364
5,216,846 * 6/1993 Takahashi ..... 451/57
5,218,786 * 6/1993 Takahashi ..... 451/226 X
5,351,445 * 10/1994 Takahashi ..... 451/41 X
5,412,737 5/1995 Matsuoka et al. .
5,640,475 * 6/1997 Takahashi et al. ..... 451/11 X

FOREIGN PATENT DOCUMENTS 2 158 750 11/1985 (GB) .
88/04217 6/1988 (WO) .

* cited by examiner

*Primary Examiner*—Timothy V. Eley
(74) *Attorney, Agent, or Firm*—Allan M. Wheatcraft

(57) ABSTRACT

A ferrule holder for holding a ferrule in a grinding apparatus, wherein said holder is e.g., substantially spherical in shape or provided with a cardanic mounting device. The ferrule holder has a cut face, a holder recess in the cut face adapted to accept the ferrule, and an attachment mechanism for attaching the ferrule within the holder recess. Moreover, a ferrule grinding apparatus is disclosed with at least one grinding plate for grinding the surface of a ferrule, at least one ferrule holder adapted to hold the ferrule and at least one ferrule positioning mechanism, wherein the ferrule holder and the said ferrule positioning mechanism cooperate together to position dynamically the ferrule such that the face of the ferrule is parallel to the surface of the grinding plate.

22 Claims, 6 Drawing Sheets

250
260
55
270a
10
150
50
170
52
20
290
270b
280

250
260
55
270a
10
150
50
170
52;290
270b
280

FERRULE HOLDER AND FERRULE GRINDING APPARATUS

The invention relates to a ferrule holder for holding a ferrule in a grinding apparatus. The invention furthermore relates to a grinding and polishing apparatus for a ferrule with at least one grinding plate for grinding the surface of a ferrule, at least one ferrule holding means adapted to hold the ferrule and at least one ferrule positioning means.

Ferrules for use in fiber-optic interconnects are known, for example, from the German Patent Application DE-A-44 23 842 (Moser et al.) assigned to IMM Institut für Mikrotechnik GmbH. Such ferrules have a series of grooves into which the individual strands of the fiber-optic cables can be laid. In an interconnect for fiber-optic cables, it is crucial to ensure that the ends of the fiber-optic strands in the two halves of the interconnect are aligned. For this purpose, the ferrule disclosed in the '842 patent application contains alignment holes into which alignment pins can be inserted.

In order to achieve optimum coupling between the two halves of the fiber-optic interconnect, it is also necessary to ensure that the matching faces of the complementary ferrules in the fiber-optic interconnect are smoothly polished and that the ends of the strands of the fiber-optic cables are planar with the surface of the ferrule. It is particularly important to ensure that when the two ferrules are connected together, the axes of the strands of the fiber optic cables in one ferrule are substantially parallel to the axes of the strands of the fiber optic cable in the other ferrule. This is difficult to achieve in conventional ferrule grinding and polishing means since it is difficult to ensure that the face of the ferrule is ground in a plane that is exactly perpendicular to the axes of the strands of the fiber-optic cable. Even slight angular deviations can lead to mismatching of the strands of the fiber-optic cable and thus to loss of signal.

The object of the invention is therefore to develop an improved holder for a ferrule which allows use in a grinding and polishing apparatus.

It is furthermore an object of the invention to produce a ferrule with a face plane substantially perpendicular to the axes of the strand of the fiber-optic cable.

It is furthermore an object of the invention to produce a ferrule holder which allows dynamic positioning of the ferrule within said grinding and polishing means.

It is furthermore an object of the invention to produce a ferrule holder which allows the use of the alignment pins within the ferrule to position the ferrule holder within the grinding and polishing apparatus.

These and other objects of the invention are solved by using a ferrule holder with a cut face and having a holder recess in said cut face adapted to-accept the ferrule and furthermore having attachment means for attaching the ferrule within said recess. Preferably the ferrule holder is substantially spherical in shape. The use of such substantially spherical ferrule holder allows dynamic adjustment of the ferrule to be carried out when the ferrule is mounted within the polishing and grinding apparatus.

Preferably the holder recess is a hole cut through said ferrule holder. This allows ease of mounting of the ferrule within the ferrule holder since it can be mounted through the side of the ferrule holder opposite from the cut face. In order to ensure that the surface of the ferrule is cut in a plane which is substantially perpendicular to that of the axes of the strands of the fiber-optic cable, the axis of the recess is substantially perpendicular to the plane of the cut face.

The ferrule can be attached within the ferrule holder by attachment means comprising a spring-loaded plate adapted to push the ferrule against one side of the recess. This spring-loaded plate is provided with a compressible surface to avoid damage to the ferrule.

In one embodiment of the invention, the spring-loaded plate is activated by a feather spring with a first end and a second end which first end is in contact with the spring-loaded plate and which second end is activated by a sledge. The sledge is mounted in a recess through the holder and is slid by means of a screw attached to one end of said sledge. The use of the sledge and screw allow very fine adjustments to be made to the pressure exerted on the ferrule and thus ensure that sufficient pressure is applied to hold the ferrule within the holder recess but not to damage the ferrule.

The objects of the invention are further solved by providing a ferrule grinding apparatus with at least one grinding plate for grinding the surface of the ferrule, at least one ferrule holding means adapted to hold the ferrule and at least one ferrule positioning means, wherein the said ferrule holding means and the said ferrule positioning means cooperate together to position dynamically the ferrule such that the face of the ferrule is parallel to the surface of the grinding plate.

The positioning means of the ferrule grinding apparatus preferably includes at least one guide pin which cooperates with at least one ferrule recess within said ferrule to position said ferrule. If the ferrule holder is of spherical shape, said shape of the ferrule holder allows the ferrule to be pivoted freely within the ferrule grinding apparatus. If the shape of the ferrule holder is not spherical, e.g. a cardanic mounting might be provided in order to achieve the necessary degrees of freedom with respect to pivotal movements of the ferrule holder necessary for obtaining the cooperation of the ferrule holder and said positioning means. A particularly suitable grinding apparatus has an arm with a recess in which the ferrule holder can freely rotate. In particular, as the ferrule holder is moved down onto the guide pin by the ferrule grinding apparatus, it can rotate to assume a position in which the face of the ferrule is in a plane perpendicular to the axis of the guiding pin. Since the ferrule is manufactured with the axes of the ferrule recesses—or alignment holes—substantially parallel to the axes of the strands of the fiber-optic cables, then the ferrule is positioned in an optimum polishing and grinding position.

Although the invention is described with reference to ferrules for fiber-optic cables, it should be noted that it can also find application in the grinding of ferrules for conventioal wire-cables.

DETAILED DESCRIPTION OF THE INVENTION

Figure 1:
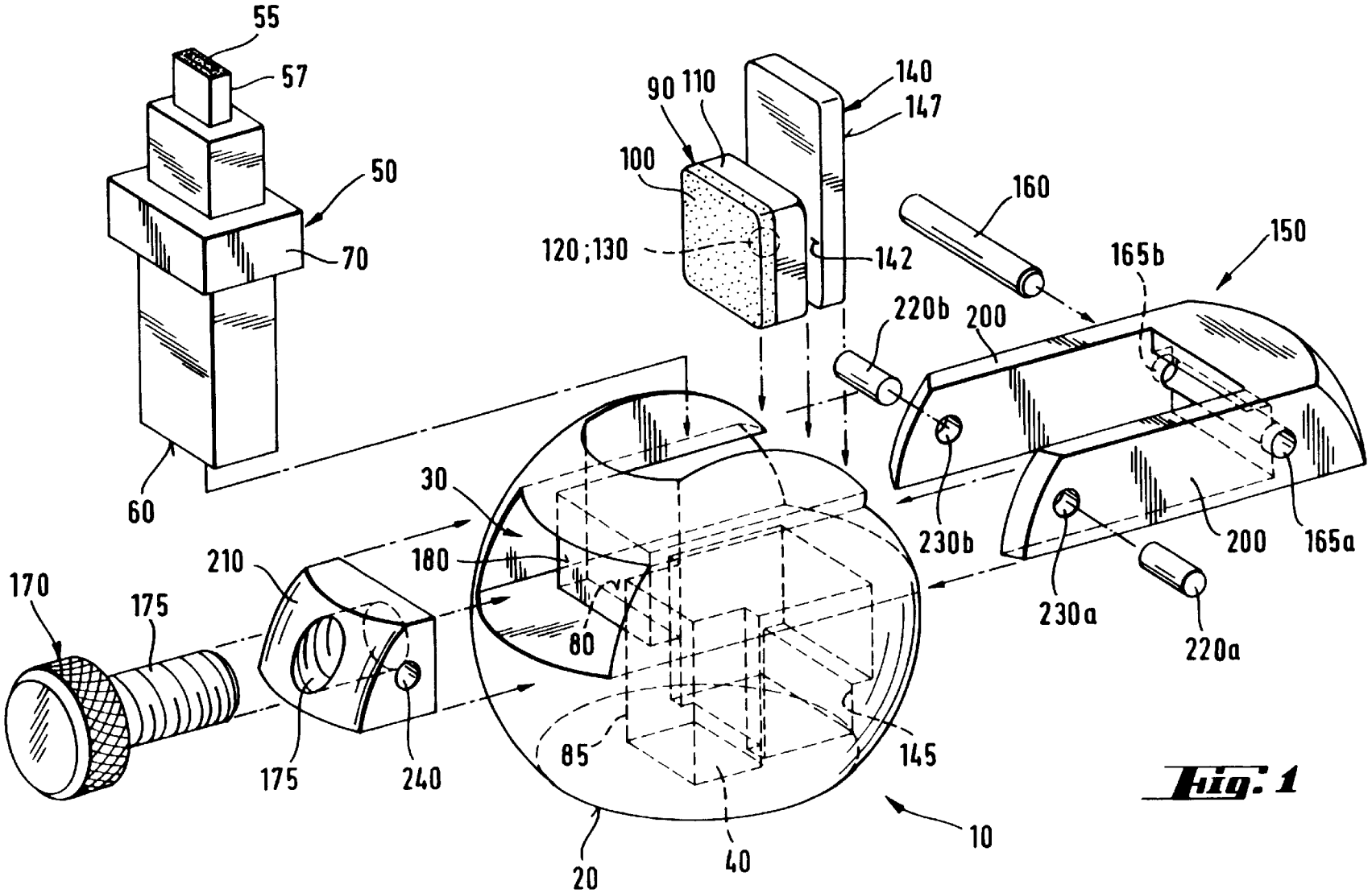
FIG. 1 show an overview of the ferrule holder according to the invention.

An overview of a ferrule holder 10 for holding a ferrule in a polishing and grinding machine is shown in FIG. 1. The ferrule holder 10 is substantially spherical in shape with a cut face 20 on a first side of the ferrule holder 10. In the disclosed embodiment, the ferrule holder 10 is provided with a groove 30 on a second side of the ferrule holder 10 and with a hole 40 passing through the ferrule holder 10 from the first side of She ferrule holder 10 to the second side of he ferrule holder 10. The hole 40 is adapted to allow a ferrule (not shown in this figure) to be inserted through the hole such that the face of the ferrule which is to be ground protrudes from the face 20 of the ferrule holder 10. The ferrule holder 10 according to this invention is made from stainless steel of a hardness similar to that used to make ball bearings supplied by Kugelfischer AG. The ferrule holder 10 could, however, be made of other materials such as very hard plastics or other hard metals.

Figure 2:
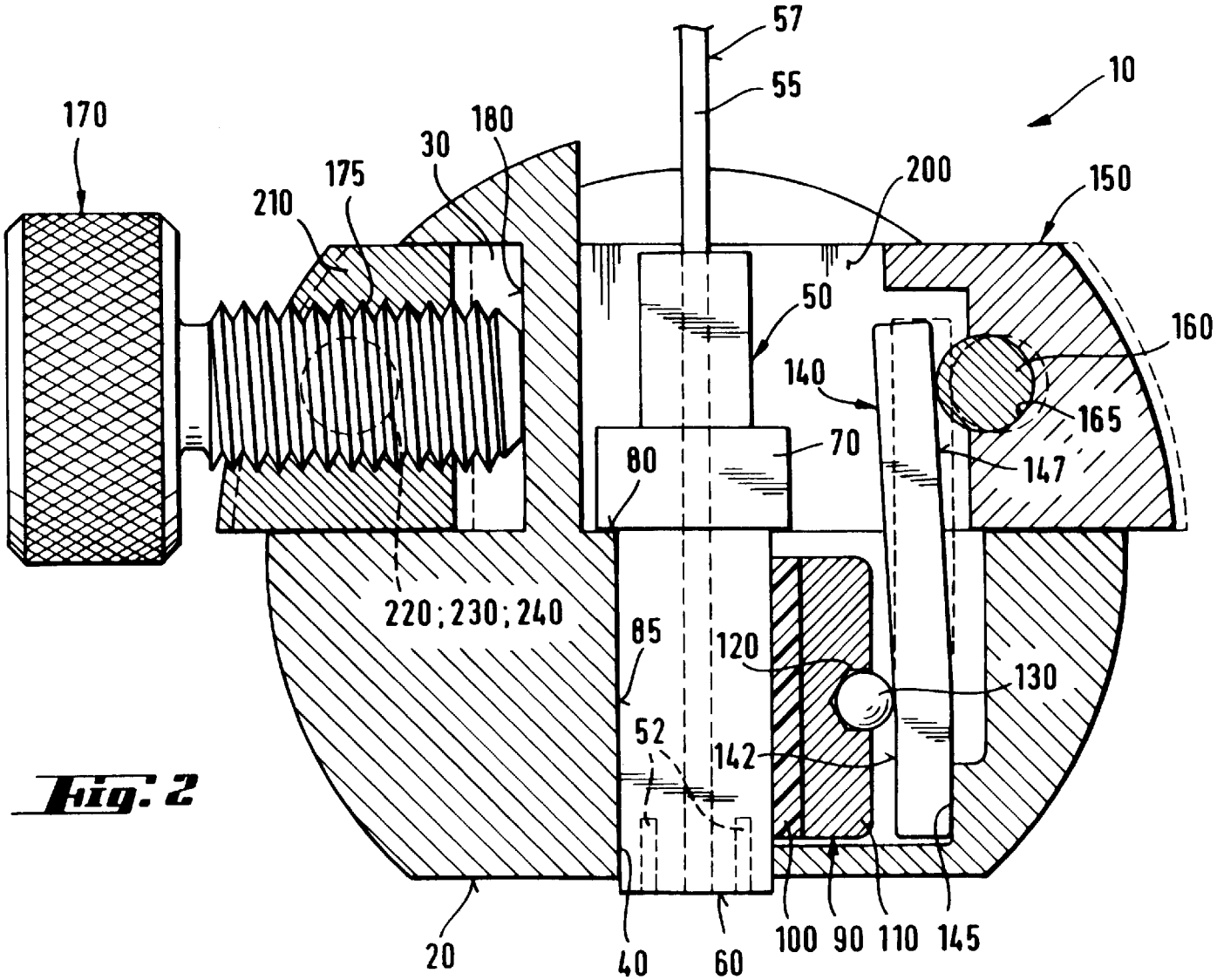
FIG. 2 shows a more detailed diagram of the internal mechanism of the ferrule holder according to the invention.

FIG. 2 shows a cross-sectional view through the ferrule holder 10. The FIG. shows a ferrule 50 attached to a fiber-optic or other cable 55 which is inserted through the hole 40 in the ferrule holder 10. The fiber-optic cable 55 is surrounded by a protective sheath 57. The ferrule face 60 which is to be ground on a grinding and polishing machine (not shown) protrudes from end of the hole 40 as is shown on the figure. The ferrule 50 is designed with a rim 70 which matches with a stop 80 machined within the hole 40 of the ferrule holder 10 to prevent the ferrule 50 from passing completely through the hole 40.

The ferrule 50 is held in position within the hole 40 by means of a plate 90 which pushes the ferrule 50 against a hole wall 85. The plate 90 is depicted as comprising a first layer 100 mounted on a support 110. The first layer 100 and the support 110 could be made of the same materials. Preferably, however, the first layer 100 is made of a compressible material such as rubber or a soft plastic and the support 110 is made of a hard material such as metal or a hard plastic. The purpose of the first layer 100 is to prevent damage to the ferrule 50 due to the force exerted on the ferrule 50 when it is pushed against the hole wall 85. It does this by ensuring that the force of exertion is spread out over the whole surface of the ferrule 50 even if there are irregularities in the surface of the ferrule 50.

The plate 90 is preferably provided with a recess 120 in the side facing away from the ferrule 50 into which a first ball bearing 130 is placed. A leaf spring 140 contacts on its first surface 142 the other side of the first ball bearing 130 and exerts force on the first ball bearing which consequently exerts force on the plate 90 and thus pushes the ferrule 50 against the hole wall 85. One end of the leaf spring 140 is held fast within the ferrule 50 by means of an attachment at a leaf spring support 145. Approximately at the other end of the leaf spring 145 a first pin 160 contacts the second side 147 of the leaf spring 145. The first pin 160 is mounted within a sledge 150 as will be described later. The sledge 150 is mounted in the groove 30 of the ferrule holder 10 and can be slid transversely to the axis of the hole 40. In the illustrated embodiment the sledge 150 is provided with holes 165*a* and 165 *b* which contain the pin 160.

The arrangement of the leaf spring 140, first ball bearing 130, first pin 160 is merely illustrative and could be replaced by other arrangements known to a skilled person. For example, the first ball bearings 130 and the first pin 160 could be removed altogether. Alternatively, the ball bearing 130 and the pin 160 could be replaced by protrusions on the surface of the plate 90 and sledge 150. Alternatively, the first pin 60 could be replaced by a second ball bearing and the first ball bearing by a pin.

The sledge 150 is moved through the groove by means of a screw 170. The screw 170 and sledge 150 are provided with matching thread 175 and the end of the screw 170 is held against a wall 180 within the ferrule holder 10. Turning the screw 170 will consequently move the sledge 140 within the groove 30 of the ferrule holder 10. The sledge 150 could be also moved within the groove 30 by other means such as pushing the sledge 150. However, providing a screw 170 is the preferred method as it allows a fine adjustment of the force exerted by the leaf spring 140 on the plate 90.

The manner in which the ferrule 50 is mounted within the ferrule holder 10 will now be described. In a first step, the sledge is slid into a position such that the second ball bearing 160 is not touching the second surface 147 of the leaf spring 140. The leaf spring 140 is thus in a position shown by the dotted line in the figure. In this position, no force is exerted by means of the first ball bearing 130 against the plate 90. The ferrule 50 is then mounted into the hole through an opening opposite to the cut face 20 of the ferrule holder 10. The ferrule 50 is slid through the hole until the rim 70 hits the stop 80 and the ferrule 50 cannot then be pushed further into the hole 40. At this point, the face 60 of the ferrule 50 should protrude slightly from the cut face 20 of the ferrule holder 10. Since the plate 90 is exerting no force on the ferrule 50, it is easy to maneuver the ferrule within the hole 40.

The sledge 150 is then moved to the right of the figure by turning the screw 170 such that the pin 160 deflects the leaf spring 140 to the position shown by the solid line in the figure. At this point the leaf spring 140 exerts a force on the first ball bearing 130 which consequently exerts a force on the plate 90 and thus on the ferrule 50 against the hole wall 85. The ferrule 50 is held securely within the hole 40.

Release of the ferrule 50 from the ferrule holder 10 is achieved in an opposite manner. The screw 170 is adjusted such that the leaf spring 140 exerts no pressure on the ferrule 50 which can thus be removed from the hole 40 by pulling on the protective sheath 57 of the fiber optic cable 55. In the illustrated embodiment, the screw 170 is preferably an M3 screw which has an end having a diameter of 5 mm and thus suitable for turning by hand.

FIG. I shows the design of the sledge 150. In this figure like parts are numbered in the same manner as in the previous figures. The sledge 150 comprises a runner element 200 and a sealing element 210. The runner element 200 is provided with two first holes 165*a* and 165*b* through which the first pin 160 passes. The sledge 150 is furthermore provided with two second holes 230*a*, 230*b* through which second pins 220*a*, 220*b* pass. The second pins 220*a*, 220*b* cooperate with sealing element recesses 240 to hold the sealing element 210 in place in the groove 30 of the ferrule holder 10.

The sledge 150 is mounted within the groove 30 of the ferrule holder 10 by sliding the runner element 200 into the groove 30 from the right hand side (in the depicted embodiment) of the ferrule holder 10 and then mounting the sealing element 200 onto the runner element 200 by means of the second pins 200*a*, 200*b*.

Figure 3:
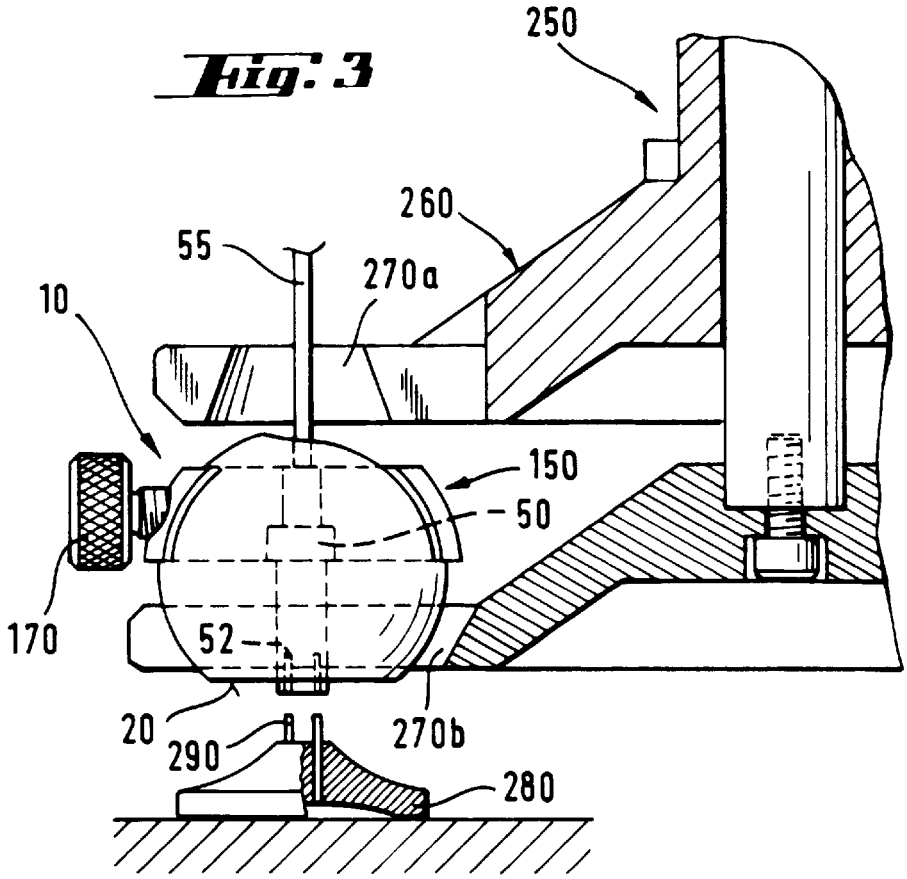
FIG. 3 shot the grinding and polishing apparatus with positioning means in an open position.
Figure 4:
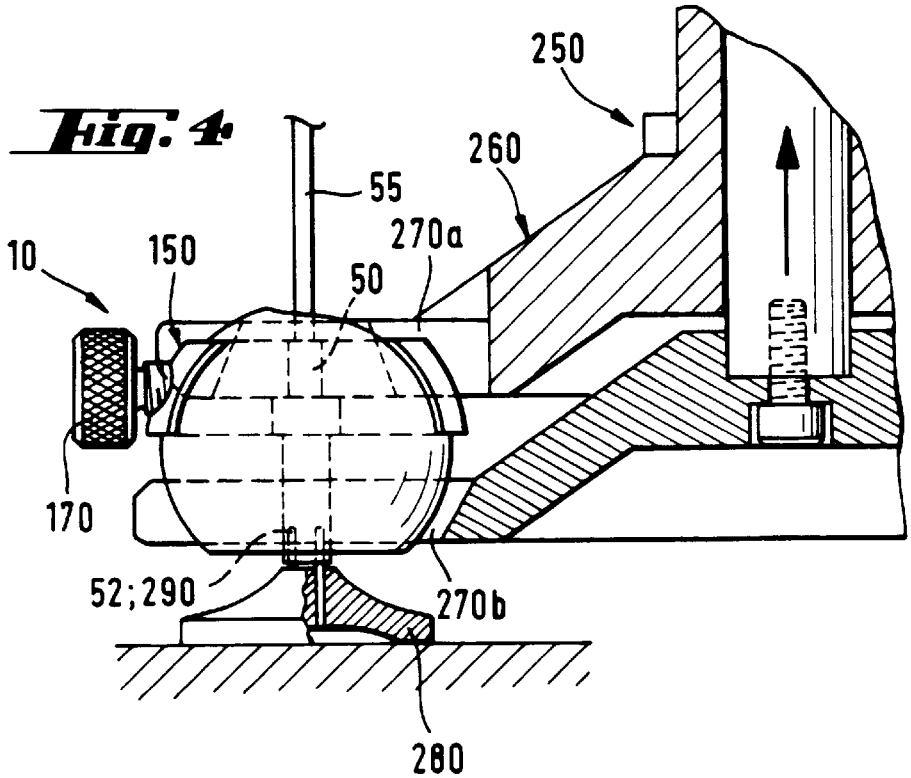
FIG. 4 shows the grinding and polishing apparatus with positioning means in an closed position.

FIG. 3 shows a polishing holder 250 of a polishing and grinding machine which comprises an arm 260 into which a first arm recess 270*a* and a second arm recess 270*b* are constructed. The arm recesses 270*a*, 270*b* are so constructed such that the ferrule holder 10 can rotate freely within the arm recesses 270*a*, 270*b*. The arm recesses 270*a*, 270*b* are also provided with securing means (not shown) which can secure the ferrule holder 10 in place such that the ferrule holder 10 can no longer rotate freely within the arm recesses 270*a*, 270*b*. The polishing holder 250 furthermore includes a positioning element 280 which has two protruding guide pins 290. These guide pins 290 are positioned such that they exactly match the ferrule recesses casa 52; c.f. FIG. 4.

Figure 5:
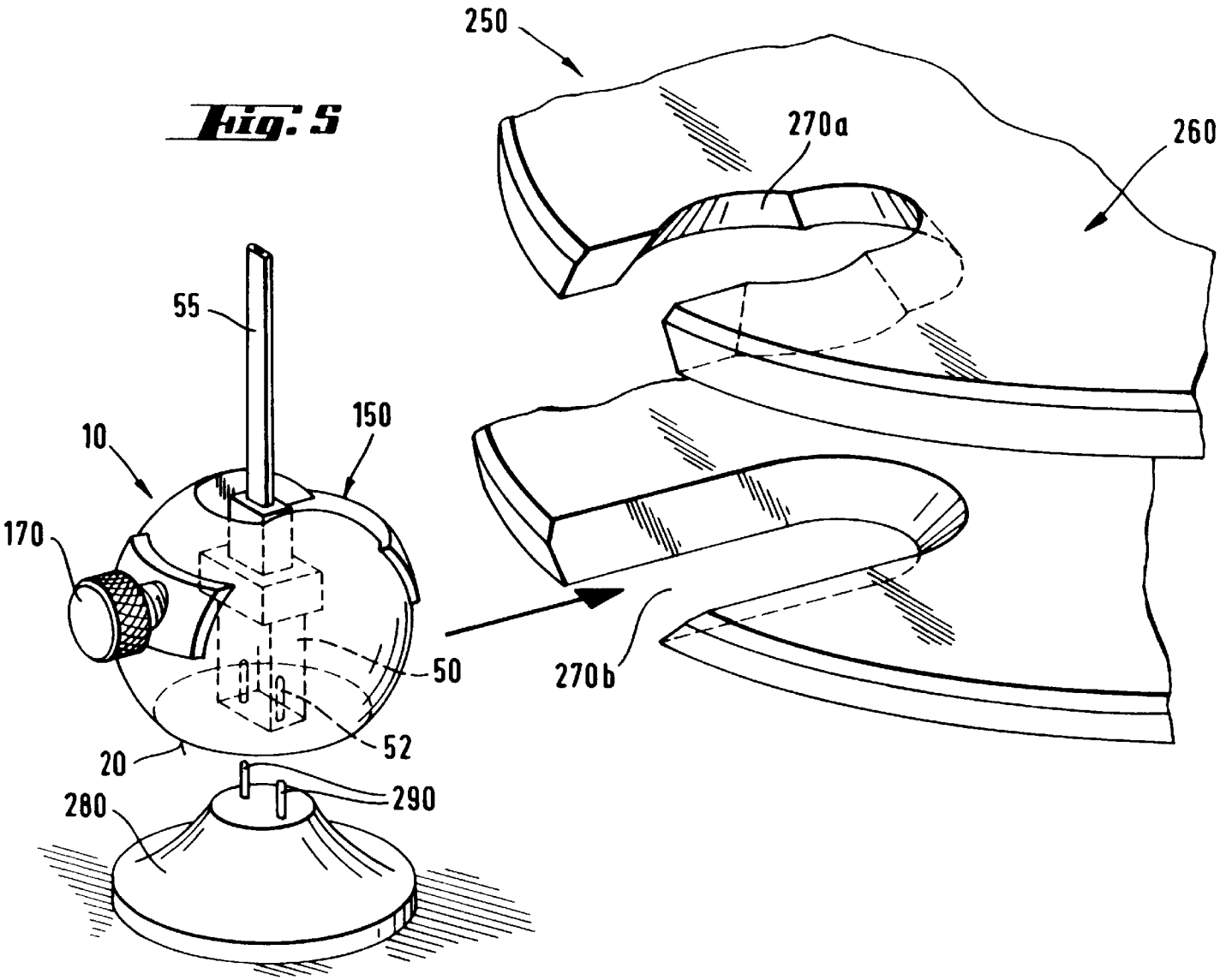
FIG. 5 shoes the arrangement of the recesses in the arm for positioning the ferrule holder.

FIG. 5 shows an exploded drawing of the end of the arm 260 in which the arm recesses 270*a*, 270*b* are depicted together with the positioning element 280 and the guide pins 290.

Figure 7:
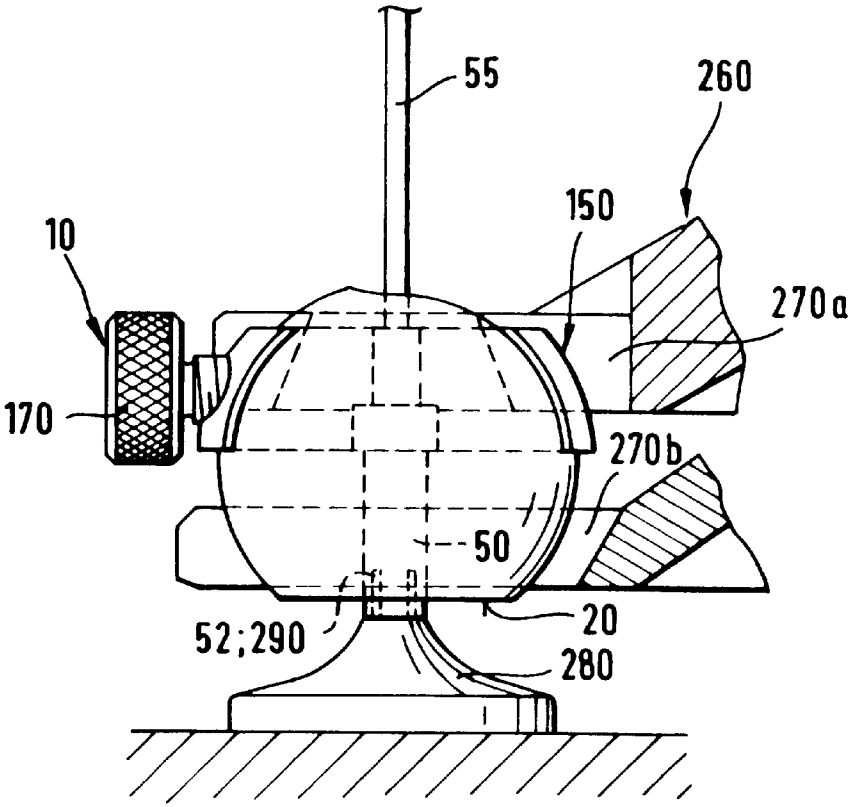
FIG. 7 shows, the grinding and polishing apparatus with positioning means in a closed position.
Figure 6:
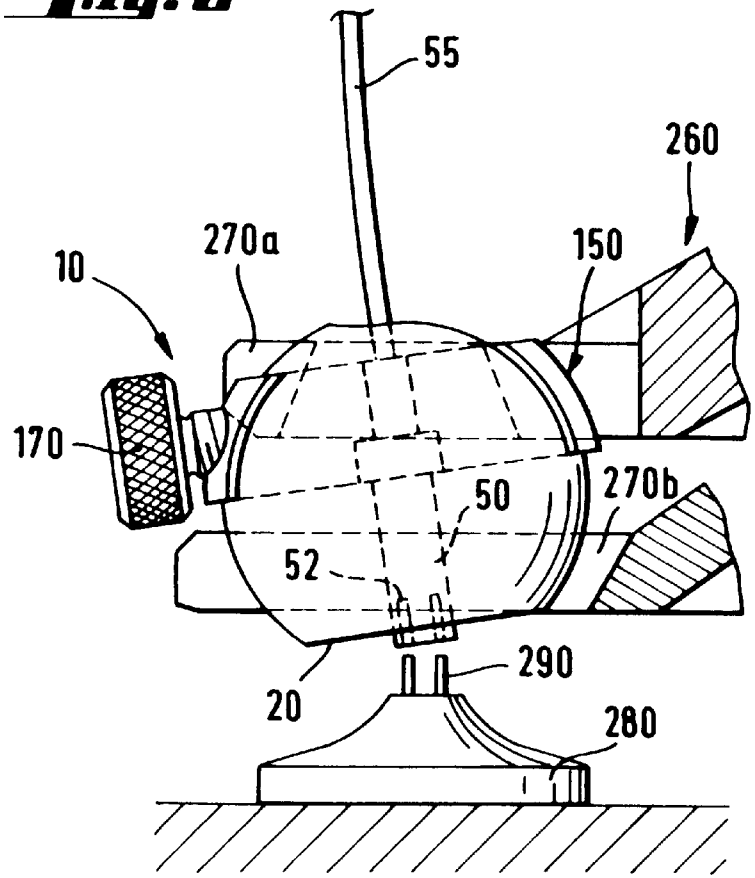
FIG. 6 is a diagram illustrating the rotation of the ferrule holder within the grinding and polishing apparatus.

The arm 260 of the polishing holder 250 is shown in FIG. 6 in the open position. In this position the ferrule holder 10 can be freely mounted between the arm recesses 270*a*, 270*b* and is able to rotate within the arm recesses 270*a*, 270*b* freely. The polishing holder 250 in FIG. 7 is shown in the closed position in which the arm is lowered such that the guide pins 290 pass into the ferrule recesses 52. The ferrule holder 10 rotates within the arm recesses 270 until the ferrule face 60 is positioned exactly planar to the positioning holder 280. At this point, the securing means are activated to ensure that the ferrule holder 10 can no longer rotate within the arm recesses 270 so that it is held firmly in place. Such means could include the application of a vacuum to hold the ferrule holder 10 in place or by providing an additional mechanical arm which holds the ferrule holder 10 within the arm 260.

FIGS. 6 and 7 show diagrammatically how the ferrule holder 10 is correctly mounted within the arm 260. Suppose the ferrule holder 10 is mounted within the arm 260 such that the ferrule face 55 is not planar to the face of the positioning element 280. This is depicted in FIG. 6. As the arm 260 of the polishing holder 250 is lowered, the guide pins 290 are inserted within the corresponding ferrule recess 52. Since the ferrule holder may rotate freely within the arm recesses 270, the ferrule holder 10 rotates until the ferrule face 60 is planar to the face of the positioning holder 280 as is shown in FIG. 7. As mentioned above the ferrule holder 10 is then fixed within the arm 260 and lifted off from the positioning holder 280.

The polishing holder 250 can then move the arm 260 in a position to allow the ferrule face 55 to be brought into contact with a polishing and grinding surface (not shown) to polish the ferrule face 55. As has been mentioned, the ferrule 50 is made of plastic and the ferrule holder 10 of stainless steel. The polishing surface used for polishing the ferrule face 60 is chosen so that only the plastic from which the ferrule is made is ground away and the stainless steel of the ferrule holder 10 is not affected.

Figure 8:
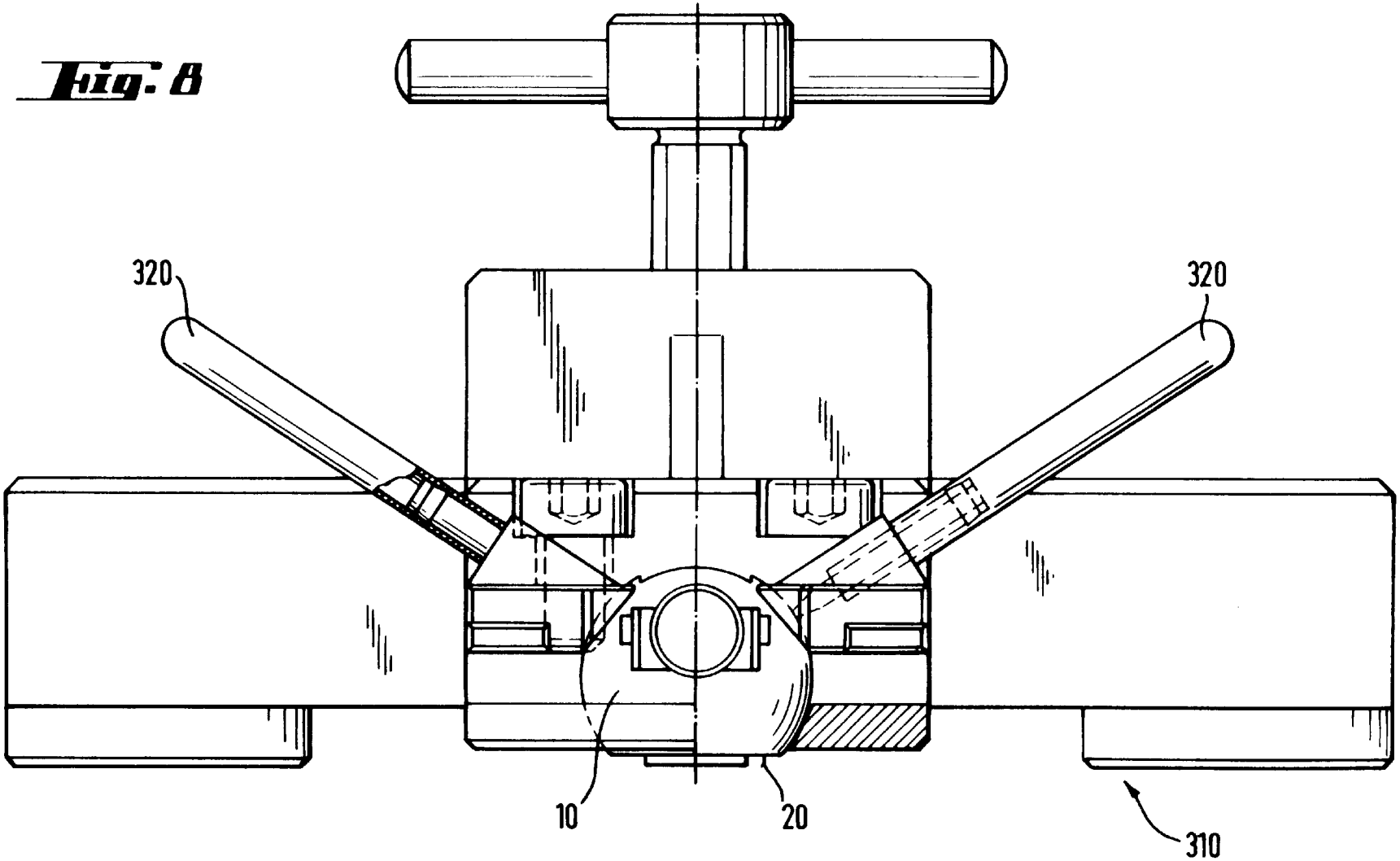
FIG. 8 shows a ferrule holder equipped with an air bearing operating with pressurized air.

FIG. 8 shows a ferrule holder 10 equipped with an air bearing means 310 operated with pressurized air supplied by tubes 320. The ferrule holder 10 is of spherical shape and pressurized air flows around it, the flow of pressurized air supporting the ferrule holder 10 and thereby minimizing any slip-stick effects with regard to the movement of the ferrule holder 10.

What is claimed is:

1. The combination of a ferrule holder and a ferrule for use in a grinding and polishing apparatus comprising:

a ferrule holder having a body and a face and being substantially spherical in shape, the face having a surface in which a holder recess is provided; and a ferrule having a substantially planar endface in which at least one ferrule recess is provided;

wherein said ferrule is mounted within said holder recess such that the endface of said ferrule projects beyond the surface of the face of said ferrule holder.

2. The combination of claim 1 wherein said holder recess comprises a hole cut through said holder.

3. The combination claim 1 wherein the axis of the holder recess is substantially perpendicular to the plane of the face.

4. The combination of claim 1 wherein the ferrule is held within said holder recess by means of a spring-loaded plate adapted to push the ferrule against one side of the holder recess.

5. The combination of claim 4 wherein said spring-loaded plate is provided with a compressible surface.

6. The combination of claim 4 wherein the ferrule holder further comprises a sledge and a feather spring adapted to activate the spring-loaded plate, the feather spring having a first end and a second end which first end is in contact with the spring-loaded plate and which second end is activated by said sledge.

7. The combination of claim 6 wherein the sledge is mounted in a groove through the holder and is slid by means of a screw attached to one end of said sledge.

8. Ferrule polishing and grinding apparatus for polishing or grinding a surface of an endface of a ferrule with:

a) at least one grinding plate having a grinding surface for polishing and grinding the surface of the endface of the ferrule;

b) at least one ferrule holding means adapted to hold said ferrule such that the surface of the endface of the ferrule is rotatable within the ferrule attachment means and is positionable to face the grinding surface of the grinding plate;

c) the ferrule held within said ferrule attachment means having at least one ferrule recess; with a central axis and d) at least one ferrule positioning means having at least one guide pin mounted thereon, wherein e) said ferrule holding means and said ferrule positioning means cooperate together by means of the at least one ferrule recess and the at least one guide pin to position dynamically the ferrule such that the central axis of the at least one ferrule recess is aligned perpendicularly to the grinding surface of the grinding plate.

9. Ferrule polishing and grinding apparatus according to claim 8 wherein the ferrule holding means comprises an arm onto which is positioned a ferrule holder having a holder recess, wherein the ferrule is mounted.

10. Ferrule polishing and grinding apparatus according to claim 9 wherein the arm has at least one arm recess in which the ferrule holder is positioned.

11. Ferrule polishing and grinding apparatus according to claim 10 wherein the ferrule holder is freely rotatable in said arm recess.

12. Ferrule polishing and grinding apparatus according to claim 9 wherein the ferrule holder has a body with a cut face and the holder recess is formed in the cut face.

13. Ferrule polishing and grinding apparatus according to claim 12 wherein the body is substantially spherical in shape.

14. Ferrule polishing and grinding apparatus according to claim 9 wherein the ferrule holder is mounted in said arm and is freely rotatable in multiple directions.

15. Ferrule polishing and grinding apparatus according to claim 8 wherein the holder recess comprises a hole cut through said ferrule holder.

16. Ferrule polishing and grinding apparatus according to claim 12 wherein the longitudinal axis of the ferrule holder is substantially perpendicular to a plane of the cut face.

17. Ferrule polishing and grinding apparatus according to claim 9 wherein said holding means comprises a spring-loaded plate adapted to push the ferrule against one side of the holder recess.

18. Ferrule polishing and grinding apparatus according to claim 17 wherein said spring-loaded plate is provided with a compressible surface.

19. Ferrule polishing and grinding apparatus according to claim 17 wherein said spring-loaded plate has a first end in contact with a feather spring and said spring-loaded plate has a second end in contact with a sledge.

20. Ferrule polishing and grinding apparatus according to claim 19 wherein the sledge is mounted in a groove through said ferrule holder and is slidable within said groove by means of a screw attached to one end of said sledge.

21. Ferrule polishing and grinding apparatus according to claim 8 wherein the ferrule holder means further includes an arm for moving the ferrule into a position above and onto the at least one grinding plate such that the at least one guide pin is insertable with the at least one ferrule recess.

22. Ferrule polishing and grinding apparatus according to claim 8 further comprising air bearing means for providing pressurized air to the ferrule attachment means such as to allow rotation of the ferrule holder within the ferrule polishing and grinding apparatus.

* * * * *